United States Patent [19]

Keim et al.

[11] Patent Number: 5,049,258

[45] Date of Patent: Sep. 17, 1991

[54] REPROCESSING OF CONTAMINATED OILS

[75] Inventors: Karl H. Keim, Swisttal-Heimerzheim; Peter Seifried, Wesseling; Hartmut Hammer, Cologne; Ralf Wehn, Bergisch-Gladbach, all of Fed. Rep. of Germany

[73] Assignee: RWE-Entsorgung Aktiengesellschaft, Fed. Rep. of Germany

[21] Appl. No.: 440,504

[22] Filed: Nov. 22, 1989

[30] Foreign Application Priority Data

Nov. 25, 1988 [DE] Fed. Rep. of Germany ..... 3839799

[51] Int. Cl.[5] ..... C10G 45/00

[52] U.S. Cl. ..... 208/184; 208/67; 208/97; 208/100; 208/106; 208/179; 208/262.1; 208/262.5

[58] Field of Search ..... 208/67, 97, 100, 106, 208/179, 184, 262.1, 262.5

[56] References Cited

U.S. PATENT DOCUMENTS

| | | | |
|---|---|---|---|
| 3,738,931 | 6/1973 | Frankovich et al. | 208/67 |
| 3,755,141 | 8/1973 | Youngblood et al. | 208/67 |
| 4,065,379 | 12/1977 | Soonawala et al. | 208/67 |
| 4,167,533 | 9/1979 | Raymond | 208/67 |
| 4,252,637 | 2/1981 | Knorre et al. | 208/184 |
| 4,512,878 | 4/1985 | Reid et al. | 208/174 |
| 4,530,753 | 7/1985 | Shiroto et al. | 208/97 |
| 4,530,754 | 7/1985 | Shiroto et al. | 208/97 |
| 4,773,986 | 9/1988 | Feldman et al. | 208/97 |
| 4,797,198 | 1/1989 | Wetzel et al. | 208/184 |

*Primary Examiner*—Helane E. Myers

*Attorney, Agent, or Firm*—Thomas H. Whaley

[57] ABSTRACT

A process is disclosed for reprocessing contaminated oils, such as used crankcase oil from automobile engines, by thermal treatment, such as visbreaking, in the presence of other hydrocarbon feedstocks, followed by fractional distillation for the recovery of a gasoline fraction, a carboxylic acid fraction, a gas oil fraction containing chlorinated hydrocarbons and a high boiling bottoms fraction. The gas oil fraction is subjected to catalytic hydrocracking with the simultaneous destruction of chlorinated hydrocarbons. The resulting hydrocracked oils, after separation of hydrogen chloride, are free from chlorine compounds and other contaminants.

11 Claims, 1 Drawing Sheet

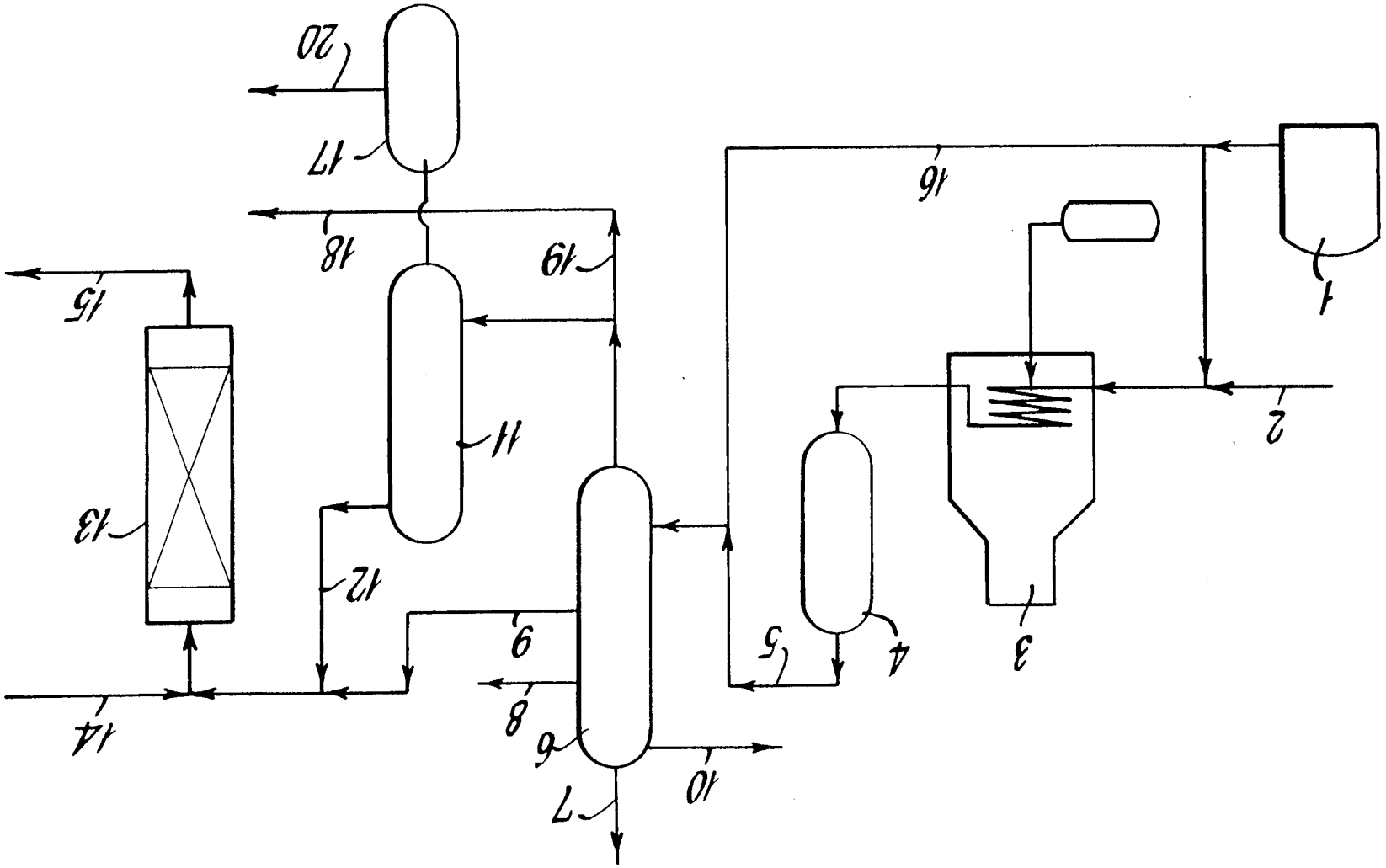
1
2
3
4
5
6
7
8
9
10
11
12
13
14
15
16
17
18
19
20

REPROCESSING OF CONTAMINATED OILS

The present invention relates to a process for reprocessing of contaminated oils by treatment in a cracking step, distillative separation of the products and subsequent hydrogenative treatment of distillate fractions.

BACKGROUND OF THE INVENTION

During the last decade experts have increasingly attended to reprocessing of used oils, which are also known as waste oils, under environmental safe conditions, whereby the term "contaminated" or "used" oils is to be considered as the more general definition.

Although a precise definition of the term "waste oil" is not available (see for example chapter 1 in K. Müller, "Reprocessing of waste oils", Erich Schmidt Verlag, Berlin 1982), the most general meaning embraces used lubricants and functional fluids, which cannot be used directly, and which are predominantly based on mineral oil, but may also be based on coal tar, plants, animals and synthesis. These materials may also be of solid or semi-solid consistency at normal temperature.

Unused lubricants and functional fluids contain numerous additives, like for example corrosion inhibitors, oxidation inhibitors, anti-foaming additives, detergents, dispersants, metal deactivators, colour stabilizers, viscosity index improvers, pour point reducing additives, wear control additives, emulsifiers etc.

By these additives, compounds of oxygen, sulfur, nitrogen, phosphorus, of metals like heavy metals, but also of other metals, halogens, silicons, numerous synthetic materials, and other compounds are present in lubricating oils and functional fluids.

During usage of fresh oil as lubricants and functional fluids, alterations of the additives take place by physical effects, like increased temperature and wear, but also by chemical processes, like for example oxidation. As a result the products of these transformations and changes are also present in used oils, like finely distributed metals, asphalthene materials, respectively materials of resin consistency and other secondary products formed by chemical changes of the additives.

Often contaminated oils of completely different origin are jointly collected. As a consequence the mixture may contain numerous solvents, water and solids. In these mixtures and in waste oils in general, the content of chlorinated compounds, in particular of polychlorodiphenyls, polychloroterphenyls, polychlorodiphenylmethans and other chlorine containing contaminations is of particular importance.

On account of these chlorocompounds, but also of metals and metal compounds, incineration of waste oils is very problematic, since the formation of toxic materials like dioxins or polychlorodibenzofurans and their emission into the environment cannot be excluded.

Regarding the very large quantities of waste oils and their importance as a raw material, incineration, which is also called energy recycling, i.e. recovery of heat energy by incineration, cannot be considered as an optimal way of handling, since materials, which are rich in hydrogen and which are therefore of great importance as fuels or feed materials for olefin plants, are only converted into water, $CO_2$ and energy. As a consequence many processes have been developed for reprocessing of used oils into re-usable oils. Reprocessing of used oils is often called secondary refining.

The conventional process is the sulfuric acid process, whereby waste oils are treated with 96 weight percent sulfuric acid. In this process so-called acid resins are formed and deposited. In a subsequent stage neutralization is carried out and the oil treated in this way is finally distilled. In general this treatment is repeated. The remaining oils which still contain contamination, have a dark colour and bad odour. As a result they are difficult to re-use. In addition disposal of the acid resins is very prolematic.

An improvement is considered to be the sulfuric acid/clay-process, whereby after treatment of the oil with sulfuric acid it is contacted with clay and subsequently distilled under vacuum (R. Meixlsperger in W. Kumpf, K. Maas, H. Straub: Garbage and waste disposal, page 395, Nr. 4010).

extraction precedes the sulfuric acid treatment (R. Dutrian and D. V. Quang, Chemical Engineering 79 (1972), page 4). A more modern process comprising a refining step with hydrogen is the KTI-process (R. F. Westerduin in: Polytechnisch tijdschrift/process-techniek 34 (1979), page 5). This process is characterized by a first vacuum distillation, followed by a distillation under high vacuum. Finally a treatment with hydrogen at approximately 50 bars and 300°-350° C. is carried out.

Obviously, in spite of these processes, an urgent need continues to exist for solutions according to which in a technically simple way the large quantities of waste oils can be worked up under conditions which take into account environmental and economical requirements.

With regard to the direct reprocessing of waste oils together with crude oil in refineries, it is disclosed in K. Müller, "Reprocessing of waste oils", published by Erich Schmidt Verlag, Berlin 1982 on page 101: "Considering the original properties, the obvious possibility of adding waste oil to crude oil before processing of the latter, in order to increase the portion of lubricant oils, can be completely excluded owing to the typical contaminations present and the negative consequences caused by these contaminations with regard to catalysts and operating conditions applied in crude oil processing. For these reasons special secondary refining processes for the reprocessing of waste oils into high quality base lube oils are mandatory."

SUMMARY OF THE INVENTION

In contrast to these prejudices resulting from the state of the art, applicant surprisingly has been successful in developing a process, which has already been applied in a technical scale in a refinery with very good results and which makes it possible to reprocess waste oils resp. used oils with excellent results within the scope of a conventional refinery, characterized in that a thermal treatment of contaminated oils is carried out in a thermal or catalytic cracking stage, that separation of fractions, which contain chlorocompounds is carried out by distillation of the cracking product and that hydrogenative refining of distillate fractions containing chlorocompounds is carried out.

DETAILED DESCRIPTION OF THE INVENTION

It is generally known that the conventional methods of processing in refineries are distillation, cracking, refining and reforming. Cracking processes used are thermal cracking, catalytic cracking and hydrocracking. Thermal cracking has the advantage that high boiling and heavily contaminated oils can be used as feed material.

Conventional thermal cracking processes are visbreaking, which is carried out at relatively low temperatures of approx. 400°-500° C., furthermore normal thermal cracking at approx. 500°-600° C. and coking, which is carried out at approx. 500° C. Catalytic cracking processes are carried out in general in a fixed-bed, fluid-bed or fluidized-bed process. The latter processes can also be applied according to the invention.

By refining of refinery streams hetero atoms, in particular nitrogen and sulfur, which are present in crude oil fractions as chemical compounds, are removed.

Although chemical refining processes are available, like the oxidation of intensely smelling mercaptans to disulfides with only a weak odour, refining by hydrogenation in the presence of a catalyst, which is stable with regard to sulfur and which contains metal components mostly consisting of combinations of Ni, Co, Mo and W, is the refining process predominantly used. By this process the heteroatoms S,N and 0 are transformed into $H_2S$, $NH_3$ and $H_2O$. Unsaturated compounds are converted into saturated hydrocarbons. Hydrogenative refining can be applied at very different conditions. Typical conditions are for example 25-100 bars and 300°-400° C., however also considerably higher pressures like for example 300 bars may be applied.

In conventional refinery operation, bottoms from atmospheric distillation, vacuum distillation or mixtures thereof are cracked by thermal cracking. The investigations of applicant have led to the result that work-up of contaminated oils is not possible, if they are, even in pre-purified condition after separation of water and filtration, directly fed into an atmospheric or vacuum distillation, because as a result of the low thermal stability of waste oils compared to crude oil fractions, coking and depositing of various material take place already after a short time of operation inside of the distillation columns, to such an extent that the columns have to be shut down and to be purified. If however, under consideration of other inventive characteristics, the contaminated oils are fed at first into a thermal treatment stage, surprisingly a troublefree operation is possible, although the total quantity of cracking product is fed into the distillation.

The investigations of applicant have shown that by heating of contaminated oils like waste oils, considerable quantities of carboxylic acids, in particular of acetic acid are formed besides HCl.

If for example after a rough separation of water, contaminated oil like waste oil is fed without pre-purification into a visbreaker, which is operated at standard conditions of approx. 10 bars, a residence time of 20 minutes and a temperature of up to 450° C., considerable chemical transformations take place, which may lead to formation of carboxylic acids and separation of HCl. The individual steps of the former transformation are not known.

Although feeding into a visbreaker as a thermal cracking stage is preferred according to the invention, other thermal or catalytic cracking processes are also within the scope of the present invention, leading to very good results, although these processes may be operated at very different conditions as known to the artisan.

From the atmospheric distillation column, which is preceded by the visbreaker, carboxylic acids, in particular acetic acid are withdrawn overhead or as an upper side-stream, where also HCl is withdrawn.

It is of advantage according to the invention, to adjust the head temperature of the distillation column to above 150° C., preferably to above 180° C. in order to avoid corrosion. The temperature can be adjusted by controlling the quantity of product withdrawn.

It is also of advantage to add corrosion inhibitors to the condensation system at the head of the column in order to avoid corrosion in this system. The gas oil fraction with the usual boiling range of 170°-360° C., which may however deviate from the range if desired, still contains chlorocompounds.

The bottoms of the atmospheric distillation, submitted to a vacuum distillation, furnish a vacuum distillate which also contains chlorocompounds.

The distillate obtained by atmospheric distillation, which is lower boiling than gas oil, as well as the bottoms of the vacuum distillation, are free however of chlorine containing compounds like polychlorobiphenyls and polychloroterphenyls or polychlorodiphenylmethans.

According to the invention, gas oil and/or vacuum distillate are subjected to hydrogenative catalytic refining, whereby active hydrogenation metals are used, in particular combinations of Ni, Co, Mo and W, deposited on conventional carriers like amorphous or crystalline zeolites, $Al_2O_3$, aluminum silicates or $SiO_2$ and others.

Hydrogenative refining can be carried out in a broad pressure range of 25-300 bars and a temperature of 280°-500° C. A preferred range of operation according to the state of the art is 25-100 bars and 280°-400° C.; particularly preferred is the range of 30-70 bars and 300°-380° C.

The products thus obtained are completely free of chlorine and can be further processed like conventional refinery streams.

According to the invention it is preferred to add a base, in particular NaOH, to the thermal or optionally to the catalytic cracking stage. It is of advantage to add 20-40 mole percent per gramatom of chlorine contained in the feed. However the quantity of NaOH can be added in a broad range of up to stoichiometric or overstoichiometric quantities. A quality which is smaller than 20 mole percent per gramatom of chlorine is less preferable.

The quantity of contaminated oil like for example waste oil may amount to greater than 0 and up to 35 weight percent based on the total feed to the thermal treatment (cracking) stage, preferably greater than 0 and up to 20 weight percent and particulary preferable, to greater than 0 and up to 15 weight percent.

If higher quantities than 35 weight percent are added, heavy coke formation and foaming may occur. In order to minimize or prevent foaming, an anti-foaming additive may be added, whereby additives known to the artisan may be used.

In case that no vacuum distillation is applied, the bottoms of the atmospheric distillation may for example be directly fed to a gasification reactor, whereby soot formed during gasification essentially adsorbs the ash resulting from the contaminated oils.

The accompanying FIGURE illustrates diagrammatically apparatus suitable for carrying out a preferred embodiment of the process of this invention.

EXAMPLE

The invention is explained in more detail with the aid of the example, represented in the figure.

From tank (1) 10 weight percent of a waste oil, consisting of numerous components were fed into visbreaker (3) in combination with 90 weight percent of a vacuum residue (2) from a vacuum distillation unit of the refinery. For the purpose of increasing the residence time, a soaker (4) is installed behind (3). The thermal cracking units are to be considered as examples. Also catalytic cracking units and other thermal cracking units and other thermal cracking units than visbreakers can be used according to the invention with very good results.

The cracking product is fed through (5) into atmospheric distillation (6). Through (7) light gasoline is withdrawn and through (10) acetic acid respectively acetic acid containing water is withdrawn. Through (8) a naphtha fraction is withdrawn and through (9) a gas oil fraction containing chlorocompounds.

The bottoms of (6) are fed to a vacuum distillation (11). Vacuum distillate flows through (12) to reactor (13) for hydrogenative refining. Through (9) gas oil can also be directly fed to (13). Through (14) hydrogen is added. From hydrogenation reactor (13) a hydrocarbon product (15) is obtained, which is completely free of chlorine The unit was operated as described, for 16 weeks without any problem.

For comparison waste oil was transferred from (1) through (16) directly to (6). After 2 weeks, inside the column heavy coke deposits were found in particular in the hot part of the column, as well as deposits resulting from amino compounds, to such an extent that the column had to be shut down. This result confirms the citation on page 4 from reference: K. Müller, "Reprocessing of waste oils", page 101.

The present invention discloses for the first time a process, which makes it possible to work up large quantities of contaminated oils with conventional refinery operation without any problems, whereby perfectly pure hydrocarbon fractions are obtained, which can be further processed by conventional methods. The bottoms of vacuum distillation (11) can be fed into a gasification unit like Shell or Texaco gasification (17) or other gasification units for example fluidized bed gasifications, or can be withdrawn through (18) as heavy heating oil. Bottoms of column (6) may also be transferred directly through (19) to (17) or (18). At (20) synthesis gas is obtained.

We claim:

1. A process for the recovery of clean hydrocarbon stock from hydrocarbon oil based used automobile engine oils contaminated with chlorinated hydrocarbons, heavy metals and additives associated with automobile engine oils which comprises:

(a) subjecting said contaminated hydrocarbon oil to thermal cracking at a temperature in the range of 400° to 600° C.;

(b) fractionating the effluent from step (a) by distillation and rectification into a light gasoline fraction, a naphtha fraction, a gas oil fraction containing chlorinated hydrocarbons, and a bottoms fraction; and (c) subjecting said gas oil to hydrorefining and recovering a hydrocarbon product therefrom which is substantially completely free of chlorine.

2. A process according to claim 9, characterized in that distillation of the cracking product consists of an atmospheric distillation, followed by a vacuum distillation.

3. A process according to claim 2, characterized in that the gas oil fraction obtained by atmospheric distillation and the distillate obtained by vacuum distillation are submitted to hydrogenative, catalytic refining.

4. A process according to claim 2, characterized in that the head temperature of the atmospheric distillation is kept at $>150°$ C., preferably at $>180°$ C.

5. Process according to claim 9, characterized in that a base is added to the thermal treatment stage.

6. A process according to claim 9, characterized in that visbreaking is applied as thermal treatment.

7. A process according to claim 9 characterized in that the quantity of contaminated oil, based on the total feed introduced into the thermal treatment stage is not greater than 35 weight per cent.

8. A process according to claim 2, characterized in that the bottoms of the atmospheric distillation and/or the bottoms of the vacuum distillation are fed to a gasification unit for the production of synthesis gas.

9. A process for reprocessing hydrocarbon oil based used automobile engine oils containing chloro compounds, heavy metals and additives associated with automobile engine oils which comprises thermal cracking of the contaminated oils at a temperature in the range of 400° to 600° C., separation of the cracking product into fractions by distillation, and hydrogenative refining of the distillate fractions containing chloro compounds.

10. A process according to claim 7 wherein the quantity of contaminated oil introduced into the thermal treatment stage is not greater than 20 weight percent of the total feed.

11. A process according to claim 7 wherein the quantity of contaminated oil introduced into the thermal treatment stage is not greater than 15 weight percent of the total feed.

* * * * *